US005396967A

United States Patent [19]

Stewart

[11] Patent Number: 5,396,967

[45] Date of Patent: Mar. 14, 1995

[54] POST HOLE DIGGER

[76] Inventor: Terence J. Stewart, 1 RD Outram, Dunedin, New Zealand

[21] Appl. No.: 200,880

[22] Filed: Feb. 23, 1994

Related U.S. Application Data

[63] Continuation of Ser. No. 3,112, Jan. 12, 1993, abandoned.

[51] Int. Cl.[6] ..... E21B 7/00

[52] U.S. Cl. ..... 175/170; 175/203

[58] Field of Search ..... 175/170, 173, 189, 195, 175/202, 203

[56] References Cited

U.S. PATENT DOCUMENTS

| | | | |
|---|---|---|---|
| 2,320,775 | 6/1943 | Garner | 175/203 |
| 2,734,722 | 2/1956 | Pokorny | 255/19 |
| 2,815,049 | 12/1957 | Herscovitch | 143/43 |
| 3,976,147 | 8/1976 | Cunningham | 175/170 X |
| 4,077,480 | 3/1978 | Carlson et al. | 173/22 |
| 4,979,578 | 12/1990 | Landry | 175/203 X |
| 4,998,590 | 3/1991 | Wells | 175/203 X |

*Primary Examiner*—Michael Powell Buiz
*Attorney, Agent, or Firm*—Merchant, Gould, Smith, Edell, Welter & Schmidt

[57] ABSTRACT

A post hole digger comprising a borer, an hydraulic driving motor for reversibly driving the borer and a frame on which the borer is mounted is described. This post hole digger has the advantage of being able to be disengaged from a hole being bored if the borer should become stuck. In addition, torque reaction from the borer striking obstructions is absorbed by the hydraulic relief valve. The borer and hydraulic motor are at opposite ends of the frame which has a fulcrum in between to allow the weight of one to counterbalance the weight of the other for ease of operation.

9 Claims, 1 Drawing Sheet

POST HOLE DIGGER

This is a continuation of application Ser. No. 08/003,112, filed Jan. 12, 1993, which now abandoned upon the filing hereof.

BACKGROUND OF THE INVENTION

This invention relates to a post hole digger. More particularly this invention relates to an hydraulically driven portable post hole digger.

Conventional mechanical:post hole digger augers usually are capable of rotating in only one direction and, therefore, have the disadvantage of being difficult to disengage if the borer should become stuck. In addition if the digger strikes an obstruction such as a large rock there can be a torque reaction which can be injurious to the operator.

Accordingly, the object of this invention is to go some way towards overcoming the disadvantages of the prior art or at least to offer the public a useful choice.

SUMMARY OF THE INVENTION

In a preferred embodiment, the invention provides a post hole digger comprising in combination: a boring implement, an hydraulic driving means for reversibly driving said implement, and a pivotal frame on which the boring implement is mounted. The arrangement and construction of the combination are such that in use the boring implement is lowered into contact with the ground by lowering the frame. The hydraulic driving means is then actuated to operate the boring implement in one direction to bore a post hole and in the opposite direction to extract the boring implement from the hole.

Preferably the boring implement is pivotally mounted onto the frame.

Preferably the boring implement is an auger.

Preferably the auger includes a replaceably mounted auger bit.

Preferably the hydraulic driving means is an hydraulic motor.

More preferably the hydraulic driving means is a slave hydraulic motor directly driving the implement and a master hydraulic motor mounted on the pivotal frame remote from the slave hydraulic motor, the slave and master hydraulic motors being connected by hydraulic lines.

Preferably the hydraulic lines are quick connect hydraulic lines.

Preferably the pivotal frame comprises a pivotal frame arm having the master motor mounted at one end thereof and the slave and borer implement mounted at the other end thereof, the fulcrum of the pivotal arm being positioned so that the weight of the master motor counterbalances that of the slave motor and boring implement.

Preferably the frame arm is telescoping.

Preferably the pivotal frame is mounted on a pair of wheels.

BRIEF DESCRIPTION OF THE DRAWINGS

In these figures like parts have been given the same numbers.

DETAILED DESCRIPTION

Construction of Preferred Embodiment

Figure 1:
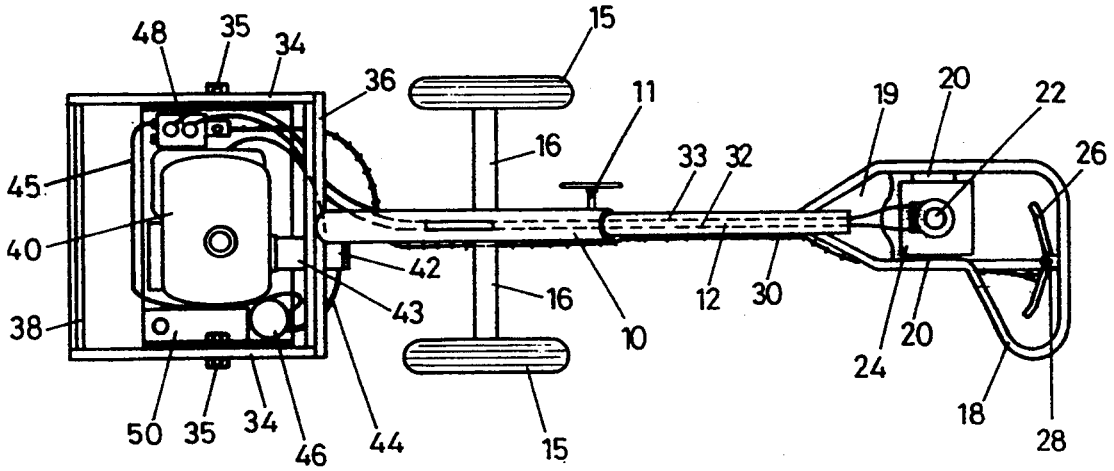
FIG. 1 is a top plan view of a preferred embodiment of the invention
Figure 2:
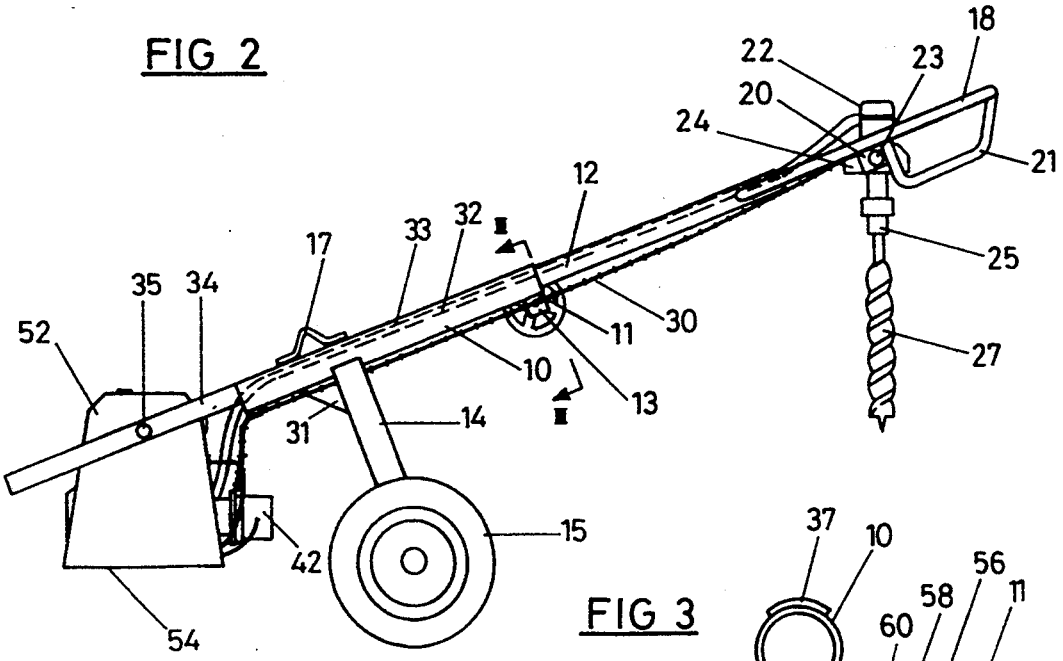
FIG. 2 is a side elevational view of the preferred embodiment of the invention.
Figure 3:
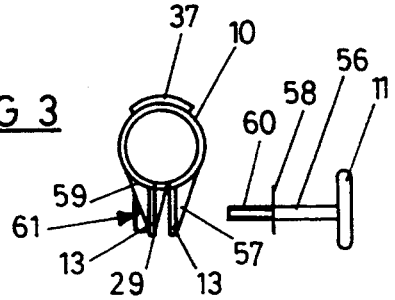
FIG. 3 is the view III—III shown in FIG. 1.

Referring to FIGS. 1 and 2 the post hole digger according to a preferred embodiment consists of a frame comprising main frame member 10, preferably of tubular construction, into which telescopes a secondary frame member 12 of corresponding cross-section. Referring to FIG. 3, there is a gap 29 extending a short way axially inwardly along the bottom of main frame member 10 from its open end. To either side of gap 29 there is welded a flange 13 whose plane is parallel to the main axis of member 10 and which projects radially downwardly. A nut 61 is welded to one flange 13 and there are aligned holes through both flanges 13. Gussets 57 and 59 reinforce flanges 13. A support bracket 37 is welded to the top of frame member 10 above the gap. Shaft 56 is threaded at one end 60, and has a flange 58 at one end of its threaded portion and a wheel 11 at the opposite end. The threaded end of shaft 56 is passed through the holes in flanges 13 and threaded into nut 61 by turning wheel 11. When flange 58 contacts one flange 13 it is drawn toward the other flange 13 closing gap 29 to lock inner frame member 12 in position. A lifting eye 17 is welded to the top of main frame member 10.

The hydraulic driving means comprises a slave motor 22 which is mounted at the right end of the frame and a master motor 40 at the left end of the frame. An upright frame member 14 extends from an axle 16 to connect with main frame member 10. A gusset 31 reinforces the joint between the upright member 14 and main frame member 10. A pair of wheels 15 are mounted at either end of axle 16. Axle 16 is mounted at the bottom of upright frame member 14. In the preferred embodiment wheels 15 are bearingly mounted for rotation about axle 16. In an alternative construction a bearing mounting is provided in the bottom of frame member 14 so that axle 16 is rotatable.

At the outer end of frame member 12 there is provided a tubular handle 18. The joint between handle 18 and frame member 12 is reinforced with gusset 19. A tubular frame guard 21 is provided below handle 18 to protect control handle 26 described below. Slave motor 22 is mounted on a motor carrier 24 which comprises a base and upright sides. Carrier 24 is pivotably mounted by shafts 23 through bearing blocks 20. An auger adaptor 25 extends downwardly from motor 22. The boring implement comprises an auger 27 which is releasably mounted in adaptor 25. The assembly is balanced so that the shaft of auger 27 remains substantially vertical regardless of the angle of frame members 10, 12 and handle 18 with respect to the horizontal. Control lever 26 is mounted on a pin between brackets 28 on handle 18. A control cable 30 (such as a bowden cable) extends from control lever 26 along handle 18 and frame members 12 and 10 to hydraulic control valve 48 at the opposite end of the device. Hydraulic lines 32 and 33 from slave motor 22 extend preferably through the centre of frame members 12 and 10 rearwardly to control valve 48 as well.

The master motor assembly is illustrated at the left side of FIGS. 1 and 2. The assembly is mounted on a frame comprising a pair of side members 34, rear member 38 and a front member 36 which is rigidly mounted at the left end of main frame member 10. Pivot pins 35 extend inwardly from side frame members 34. A motor carrier comprising a side portion 52 and a bottom portion 54 are mounted on pins 35. The position of the mounting is such that when the apparatus resting on the motor support bottom 54 is in place, the bottom 54 remains substantially horizontal irrespective of the angle of frame members 10 and 12.

Mounted on the support bottom 54 is a master hydraulic motor 40 connected through a hydraulic pump adaptor 43 to hydraulic pump 42. Hydraulic reservoir 50 is connected to return filter 46 while control valve 48, which incorporates a pressure relief valve, is the other component of the master hydraulic system. Hydraulic lines 44 and 45 connect control valve 48, filter 46 and hydraulic pump 42.

The connections at the master motor end of hydraulic lines 32 and 33 and of the connector cable 30 are quick connect couplings so that the master motor assembly or power pack may be used to drive other apparatus such as hydraulic drills, pruners or trimmers in place of the post hole boring auger described in FIGS. 1 and 2.

Operation of Preferred Embodiment

For ease in portability frame member 12 is telescoped into frame member 10 and auger bit 27 is removed. This reduces the overall length of the apparatus. The auger end of frame member 12 may rest on guard 21 during transport.

When the apparatus is in the vicinity of the site for boring the post hole frame member 12 is extended from frame member 10 and locked in position using wheel 11. Wheels 15 may be anchored by chucks or other convenient means. For fine positioning of the auger bit 27 the operator holding handle 18 may move the frame member 12 relative to frame member 10. The master hydraulic motor 40 is then started with the lever 26 positioned so that valve 48 is in a neutral position. The operator then lowers handle 18 until bit 27 contacts the ground. The operator then pivots the control lever 26 to place the valve 48 in the operating position so that fluid is driven in lines 32 and 33 in a direction to drive slave motor 22 so as to rotate auger bit 27 to penetrate the ground. When the desired depth is reached the operator reverses the control lever 26 to reverse the direction of operation of hydraulic motor 22. The operator then guides the auger bit 27 out of the bore hole by lifting handle 18.

When the required post holes have been completed the master motor 40 is shut down, the frame member 12 is telescoped back into a retracted position and auger bit 27 is removed from adaptor 25.

If during the course of operation the auger bit 27 becomes stuck it can be readily released by pivoting lever 26 to reverse the direction of rotation of slave motor 22 and hence of auger bit 27. If the auger bit 27 strikes an obstruction such as a rock or other solid object the torque reaction is absorbed by the pressure relieve valve in the control valve 48 rather than causing injury to the operator.

The position on frame member 10 of upright frame member 14 is chosen so that the weight of the master motor 40 and its associated components counterbalances the weight of the remainder of frame member 10, frame member 12 and the auger assembly and handle. This relieves the workload on the operator who is required only to guide the apparatus rather than to lift and lower it. Handle 18 is offset in the manner illustrated so as to allow the auger bit 27 to be positioned as close as possible to obstructions such as trees or walls. The operator would normally stand in a position somewhere below the motor 22 as illustrated in FIG. 1.

To those skilled in the art to which this invention relates many changes in construction and widely, differing embodiments and applications will suggest themselves without departing from the scope of the invention as defined in the appended claims. The disclosures and descriptions herein are purely illustrative and are not intended to be in any sense limiting.

I claim:

1. A stand alone portable post hold digger comprising in combination:

i) a boring implement;

ii) a pivotal elongate frame on which the boring implement is pivotally mounted proximate one end, the frame being adapted to lower the boring implement into contact with the ground and counterbalanced to assist in raising and lowering the boring implement; and iii) hydraulic driving means, the driving means being adapted to drive the boring implement in a first direction to bore a post hole, and in the opposite direction to extract the boring implement from the hole.

2. A post hold digger according to claim 1 in which there is provided a handle and hydraulic drive control means proximate the end of the pivotal elongate frame at which the boring implement is mounted.

3. A post hole digger according to claim 1 wherein the boring implement is an auger.

4. A post hole digger according to claim 3 wherein the hydraulic driving means comprises a slave hydraulic motor directly driving and pivotal with the boring implement and a master hydraulic motor mounted proximate another end of said elongate frame remote from the end where the slave hydraulic motor and boring implement are mounted, the salve and master hydraulic motors being connected by hydraulic lines.

5. A post hole digger according to claim 1 wherein the hydraulic driving means is an hydraulic motor.

6. A post hole digger according to claim 5 wherein the master motor is pivotally mounted on said pivotal elongate frame.

7. A post hole digger according to claim 1 wherein the hydraulic driving means includes a pressure relieve valve.

8. A post hole digger according to claim 1, wherein the pivotal elongate frame is telescoping.

9. A post hole digger according to claim 1, wherein the pivotal elongate frame is mounted on a pair of wheels.

* * * * *